US005450794A

United States Patent [19]

Drimmer

[11] Patent Number: 5,450,794

[45] Date of Patent: Sep. 19, 1995

[54] METHOD FOR IMPROVING THE PERFORMANCE OF UNDERWATER EXPLOSIVE WARHEADS

[76] Inventor: Bernard E. Drimmer, 707 E. Franklin St., Silver Spring, Md. 20901

[21] Appl. No.: 327,152

[22] Filed: Nov. 29, 1963

[51] Int. Cl.[6] ..... F42B 1/00

[52] U.S. Cl. ..... 102/309; 102/305; 102/406; 102/475; 102/701

[58] Field of Search ..... 102/8, 10, 22, 23, 24, 102/301, 305–310, 390, 401, 406, 424, 475, 476, 701; 181/58 B

[56] References Cited

U.S. PATENT DOCUMENTS

| | | | |
|---|---|---|---|
| 1,292,408 | 1/1919 | Subrecki | 102/396 |
| 2,763,210 | 9/1956 | Church et al. | 102/307 |
| 2,775,940 | 1/1957 | Klotz | 102/701 |
| 2,999,458 | 9/1961 | Caursen | 102/305 |
| 3,027,838 | 4/1962 | Meddick | 102/309 |
| 3,076,408 | 2/1963 | Poulter et al. | 102/305 |

FOREIGN PATENT DOCUMENTS

| | | |
|---|---|---|
| 1033565 | 7/1953 | France . |
| 874431 | 8/1961 | United Kingdom . |

*Primary Examiner*—Harold J. Tudor

[57] ABSTRACT

A solid explosive charge is provided with plural detonators on its outer surface at locations from which divergent shock waves simultaneously emerge for movement inwardly of the explosive body. Such shock waves form an uninterrupted wave front enclosing a progressively decreasing volume of the explosive as it converges toward the center of the charge to correspondingly increase peak implosion pressure within a body of water.

5 Claims, 2 Drawing Sheets

METHOD FOR IMPROVING THE PERFORMANCE OF UNDERWATER EXPLOSIVE WARHEADS

The invention described herein may be manufactured and used by or for the Government of the United States of America for governmental purposes without the payment of any royalties thereon or therefor.

The present invention relates to underwater explosions and is directed to a means and method for increasing the peak pressure of the shock wave produced in the water by a detonating explosive charge. The method is to cause the explosive charge to implode rather than explode, the meaning of which terms is to be explained below.

With a view of increasing the total energy content of a given volume explosive mixture, fine metal powders, normally aluminum, have been added to the explosive. Due to its relatively slow rate of reacting chemically during the detonation process, the energy released by the oxidation of the metal, is delayed and to a great extent, shows up as bubble-pulse energy (in an underwater explosion), at the expense of the shock-wave energy. For example, in some detonation-velocity experiments with TNETB (trinitro-ethyl-trinitrobutyrate; $C_6H_6N_6O_{14}$) containing either finely-divided boron, aluminum, and zirconium, analysis of the results indicated that these powders were behaving as inert materials, at least within the time scale of the detonation reaction zone duration.

Since the damage-producing ability of an underwater detonation is controlled more by the energy in the first shock wave, as compared to the bubble-pulse energy, it is desirable to increase the proportion of the detonation energy going into that shock wave, as compared to that going into the bubble-pulse. It is an object of the present invention to increase the amplitude of the shock pressure in the water from an underwater explosion.

It is a further object of the invention to provide a method of detonating an underwater explosive charge which increases the temperature in the reaction zone, and increases the speed and completeness of the chemical reactions within that zone, all of these changes being compared to the corresponding characteristics in a normal explosion.

It is a further object of the invention to provide a method of detonating an underwater explosive wherein, during the detonation process, the particle velocities of the explosion products are directed-inwardly, toward the center of the charge, causing the detonation wave to be convergent, as contrasted with its normal, divergent form.

A still further object of the invention is to increase the peak pressure in the water, due to an underwater detonation, merely by changing the mode of initiation of the explosive charge.

Other objects and many of the attendant advantages of the present invention will become more readily apparent upon reading the following specification taken in combination with the drawings wherein.

Figure 1:
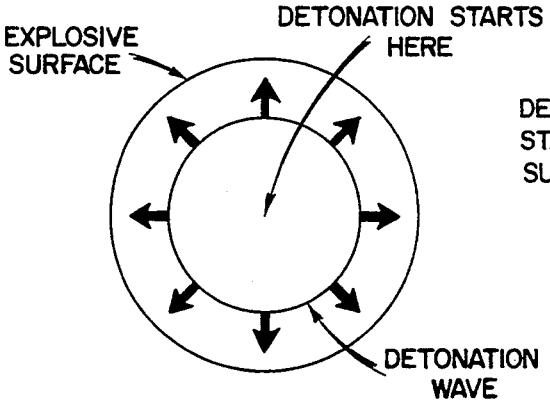
FIG. 1 illustrates the direction of the detonation wave in a typical, centrally-initiated exploding system.
Figure 2:
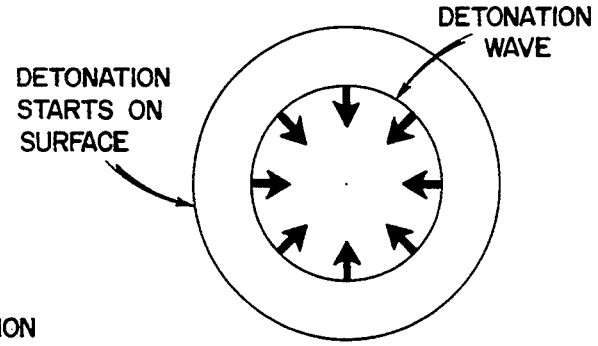
FIG. 2 illustrates the direction of the detonation wave in a spherical imploding system.
Figure 3:
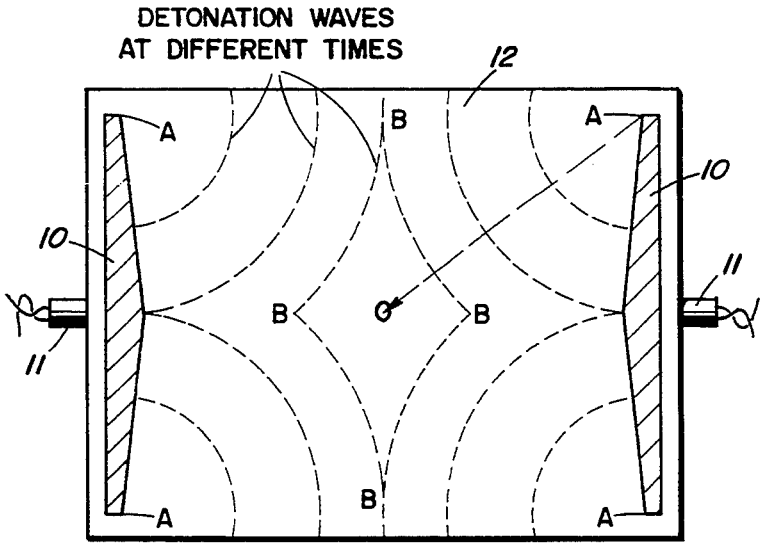
FIG. 3 shows a cylindrical depth charge, partly in section, rigged for an implosive detonation.
Figure 4:
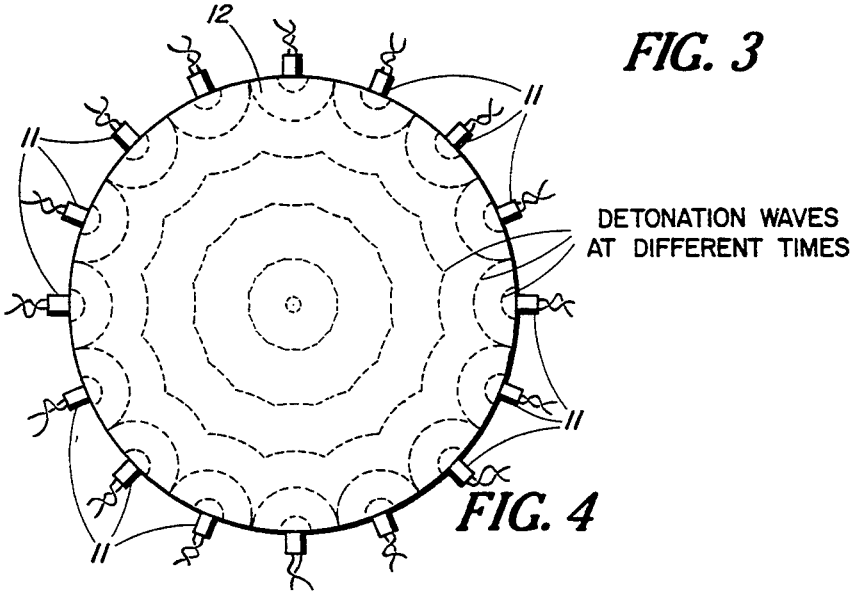
FIG. 4 illustrates a spherical explosive charge, partly in section, whose efficiency and completeness of reaction is increased over the system of FIG. 3.

To understand the mode of operation of this invention, consider a normal,steady state detonation, typified here by FIG. 1. In this type of detonation the physical-chemical system can be considered as a system in dynamic equilibrium, wherein at a given distance behind the detonation front, conditions such as pressure, temperature, density, extent of chemical reaction, and so on, are always the same, as the detonation moves forward. To simplify the explanation, consider that the highly complex set of chemical reactions within the reaction zone can be represented by a single, simple chemical reaction. Since the temperature profile in the reaction zone is fixed, it follows from physical-chemical principles that the reaction rate varies with the temperature profile. However, at any single point within the zone the temperature is fixed, and so is the reaction rate at that point. If, now, a reaction (within the highly complex set of reactions) is taking place at all during the detonation, but only to a negligible degree by the time the Chapman-Jouguet plane is reached, then physical-chemical principles state that an increase in temperature within the reaction zone by only a few hundred degrees would increase the reaction rate by several orders of magnitude. Such an increase in reaction rate would obviously make available for possible use many energetic though slow-reacting, chemical reactions not feasible under normal detonation conditions. The invention causes an increase in the temperature of a detonation reaction zone, as described below, and thus can "drive" to completion many chemical reactions that would either be incomplete or would not react to an appreciable degree, under normal explosion conditions.

in FIGS. 2, 3 and 4 the detonation waves are propagated inwardly by the simultaneous initiation of detonators 11 on the charge surfaces. Due to the symmetry of the cylindrical charge in FIG. 3, inert barriers 10 are required to cause the shock waves to converge toward point 0. Otherwise, divergent shock waves would travel through the charge in opposite directions with the effect of adding only a negligible amount of shock energy to the reaction than is present in an ordinary explosion. In FIG. 3 the distance between the axial pairs of points A should be approximately equal to the diameter between the radial pairs of points A. Substantially simultaneous initiation of the two detonators may be readily and cheaply accomplished by a number of different schemes, permitting points A to ignite simultaneously, causing the detonation waves to converge as shown toward point 0, the point of central symmetry of the charge 12. While this scheme causes an implosion that is far from ideal, it is readily seen that the major portion of the main charge bounded by points A detonates toward the central point of the cylindrical charge. Within the region bounded by points B, the conditions approach those of an ideal implosion.

The method of causing shock wave convergence toward the charge center is not limited by the use of inert barrier for the cylindrical charge explosion. The initial implosion in FIG. 3 may also be produced by the use of air lenses, or by a two-explosive lens system. As a safety feature not necessary to the operation of this system, where inert barriers are used, the barrier materials should be compressible and pliable to prevent pinching of the explosive. Polyethylene, for example, has been found useful as an inert barrier material.

The type of explosive is not critical to perform the method of the present invention and Composition B, 50/50 Pentolite, HBX-1, HBX-3, among other explosives have been employed with success in underwater implosions of the type shown in FIG. 4.

In FIG. 4 inert barriers are not necessarily required to produce converging shock waves. When detonators 11 uniformly spaced on the spherical surface of the explosive charge in FIG. 4, are simultaneously initiated, divergent detonation waves are propagated inwardly, and reacting with one another, produce a resultant convergent detonation wave within the charge in the manner suggested by the internal constant-time contour lines of the detonation front.

Referring to FIGS. 2, 3 and 4 and considering the effect of an implosion in the charges of FIGS. 3 and 4, two beneficial effects will be derived as the detonation wave and its associated particle velocity are propagated inwardly. The initial stages of the expansion of the resulting gas bubble will be slower when compared to the corresponding case of a central initiation (FIG. 1). Secondly, the detonation velocity and the associated pressure and temperature in the reaction zone will increase as the radius of the detonation wave decreases. As a consequence of the latter effect, the probability of causing or accelerating a metal, explosive-products chemical reaction increases significantly in addition, it can be readily demonstrated that the residence time of the metal powder in the high-pressure, high-temperature explosion products is greatly increased. This residence time is defined as the time in which the metal and products exist at a temperature and pressure above a critical level. Thus the implosion increases the probability of an earlier and more complete reaction involving the metal addend, as compared to the case of a normal explosion.

During the implosion phase, a shock wave will be driven into the surrounding medium due to expansion of product gases from the outer layers of the explosive. However, the initial amplitude of the shock wave will be lower than that of the corresponding shock wave caused by a centrally initiated explosion. When the detonation reaches the center of the explosive, shock reflection will occur causing a new shock to radiate from that point. Passing through the explosive products, the shock wave will pick up energy from any metal-products reaction that occurred since the first passage of the wave. This second shock wave will thereafter pass into the surrounding medium and shortly catch up with the first shock wave. Thereafter, only a single shock wave will be propagated into the water, having a peak pressure at any given point greater than that due to the normal explosion of an identical charge.

The implosion, with its higher reaction-zone temperatures and pressures, supplies the proper conditions to initiate reactions whose activation energies are not exceeded by the conditions prevailing in the reaction zone of a normal detonation.

In addition to the above chemical reasons for using implosions, other, hydrodynamic, benefits can be anticipated. As the implosion proceeds, the "tail" of the detonation wave presses against the surrounding medium while the "head" proceeds inwardly, initiating the above-cited chemical reactions. These reactions could conceivably take many microseconds for completion. As the "head" of the detonation wave reaches the center of the explosive charge and reflects outwardly, the second shock wave traverses the relatively slow reacting medium. Thus the slow reactions are given a "second chance" to accelerate, adding to the energy available for the first shock wave experienced by a target within the water.

A consequence of the fact that a normal explosion hits the water with its "head" while an implosion hits it with its "tail" is that the shock pressure in the water for the first few inches from the charge would be much higher for the explosion then for the implosion. The associated high temperatures in this close-in region of the water would imply that more detonation energy would be wasted in irreversibly heating the water in the case of the explosion as compared to the implosion. It would naturally follow that beyond this immediate proximity of the charge this waste of energy would result in lower shock pressures within the water.

Figure 5:
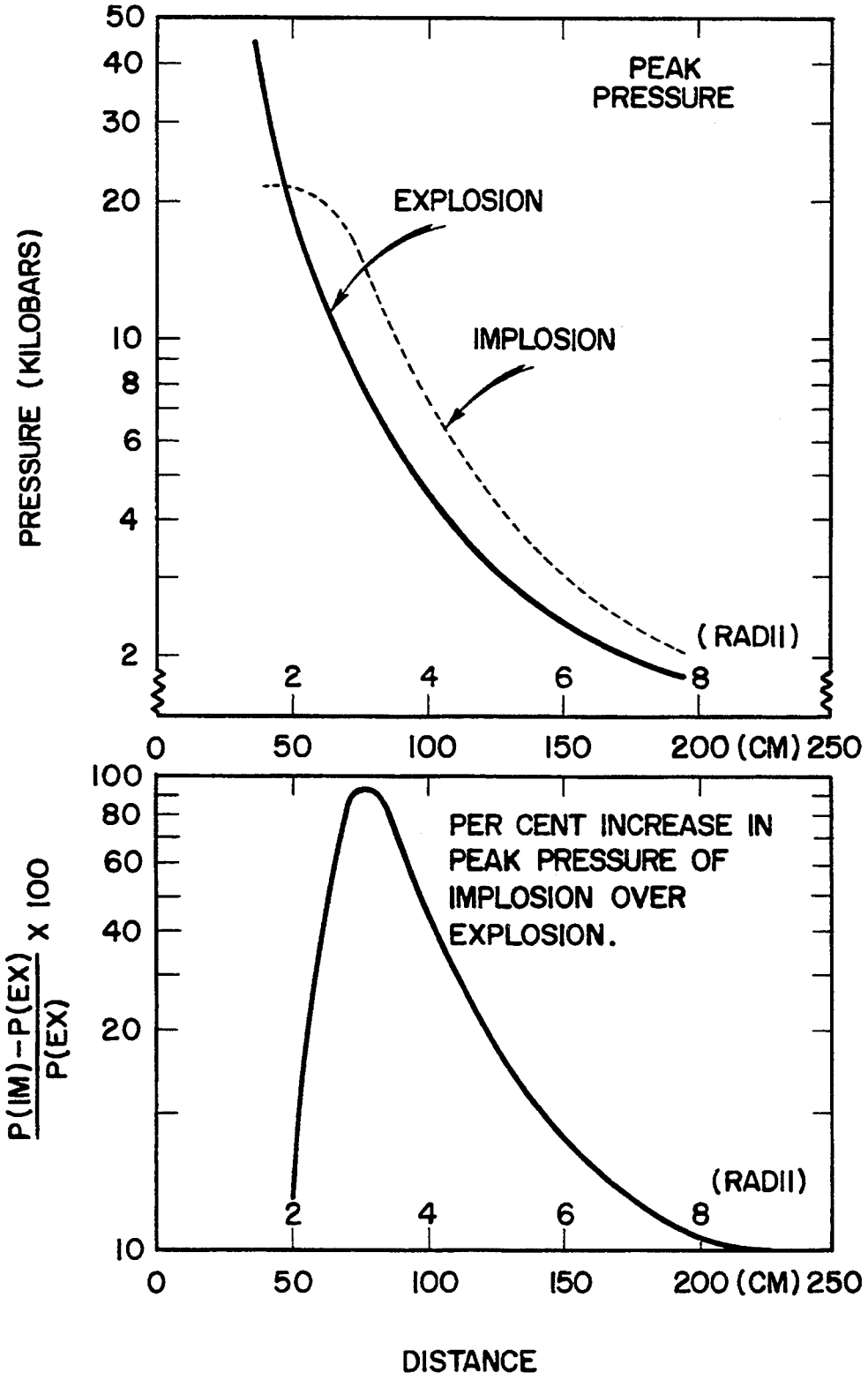
FIG. 5 shows the merit of the implosion system in regard to an increase in the peak pressure of the shock wave for the imploding system over that of the exploding system.

The graphic results displayed in FIG. 5 show the merit of the implosion system over that of an explosion, with regard to the increase in peak pressure in the water. By changing only the mode of initiation, and without extracting any additional energy from the explosive, the peak pressure in the water is increased in the near neighborhood of the detonation. Some of this additional pressure is explained by the fact that energy is not excessively dissipated in heating the water as is the case in the explosion system; most of the increase in the pressure comes from the more favorable mode of feeding energy into the surrounding medium.

The high pressures and their relatively long durations within the product gas bubble of the implosion system indicate that there are excellent probabilities of forcing many energetic reactions not feasible in explosion systems. Many of these reactions, started by the inward moving shock wave, could conceivably be pushed to completion by the outward moving, or reflected shock. In this case the total output energy of the system would easily exceed the presently available output energy of the simple Composition B for a normal explosion. This would result in a further increase in the peak pressure of the shock wave in the water for the implosion system, making it even more attractive than is indicated in present computations.

The method of detonation herein has a wide application with explosives used in underwater ordnance. In FIG. 5 it is seen that between one and two charge radii beyond the charge-water interface, the pressure in the water due to the explosion is higher than that due to the implosion beyond two charge radii, where most military targets will be found, the reverse is true. The increase in the pressure due to the implosion is shown as a function of charge radii in the lower graph in FIG. 5. At three charge radii the increase in peak pressure is 100%, i.e., the implosion peak pressure is twice that of the explosion. This improvement factor decreases as the shock moves outwardly, until at eight charge radii the increase in pressure is only about 10%.

The method of this invention has proved effective when the charge is imploded between the range of approximately two charge radii and approximately 30 charge radii from the target. This range has been defined as a "close in" range, but the performance of the above method is not necessarily limited thereto.

Various modifications are contemplated and may be obviously resorted to by those skilled in the art without departing from the spirit and scope of the invention. It is therefore to be understood that within the scope of the appended claims, the invention may be practiced otherwise than as specifically described.

I claim:

1. A multi-detonator implosion forming system for increasing the peak pressure of a shock wave in water; said system comprising:

an explosive charge which is solid from its outer surface to its center;

means including a plurality of detonators uniformly spaced on the surface of said charge for directing a plurality of simultaneously initiated divergent shock waves inwardly of said charge and for producing a resultant convergent uninterrupted shock wave front within said charge which completely encloses a progressively smaller volume of said charge as said shock wave front converges to a point at the center of said charge.

2. A multi-detonator implosion forming system for increasing the peak pressure of a shock wave in water; said system comprising:

a solid cylindrical explosive charge, detonators mounted at each end of said cylindrical charge, and an inert barrier mounted in close proximity to each detonator between the detonator and the center of said cylindrical charge for directing a plurality of simultaneously initiated divergent shock waves inwardly of said charge and for producing a resultant convergent uninterrupted shock wave front within said charge which completely encloses a progressively smaller volume of said charge as said shock wave front converges to a point at the center of said charge.

3. The combination of claim 2 wherein said inert barrier is a pliable and compressible material, said barrier having diameter less than the diameter of said cylindrical charge.

4. The combination of claim 3 wherein said pliable and compressible material is polyethylene.

5. A multi-detonator implosion forming system for increasing the peak pressure of a shock wave in water; said system comprising:

a completely solid spherical explosive charge, a plurality of detonators positioned in opposing relationship at uniformly spaced intervals around the outer surface of said charge for directing, upon detonation thereof, a plurality of simultaneously initiated divergent shock waves inwardly of said spherical charge and for producing a resultant convergent uninterrupted shock wave front within said change which completely encloses a progressively smaller volume of said charge as said shock wave front converges to a point at the center of said charge.

* * * * *